US006865853B2

(12) United States Patent
Burken et al.

(10) Patent No.: US 6,865,853 B2
(45) Date of Patent: Mar. 15, 2005

(54) BASE ASSEMBLY FOR WALL PANEL CONSTRUCTION

(75) Inventors: David J. Burken, Blue Grass, IA (US); James C. Fitzgerald, Cedar Rapids, IA (US); William J. McKibbin, Wilton, IA (US); Christian J. Kleppe, Muscatine, IA (US); Robert Nichols, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/355,946

(22) Filed: Jan. 31, 2003

(65) Prior Publication Data

US 2004/0154267 A1 Aug. 12, 2004

(51) Int. Cl.[7] ..... E04B 2/82
(52) U.S. Cl. ..... 52/239; 52/220.7; 160/135
(58) Field of Search ..... 52/220.7, 239, 52/242; 160/135

(56) References Cited

U.S. PATENT DOCUMENTS

| | | | | |
|---|---|---|---|---|
| 4,203,639 A | * | 5/1980 | VandenHoek et al. | 439/215 |
| 4,416,093 A | * | 11/1983 | Salkeld et al. | 52/71 |
| 4,593,505 A | * | 6/1986 | Russell | 52/220.7 |
| 4,918,886 A | | 4/1990 | Benoit et al. | |
| 5,062,246 A | | 11/1991 | Sykes | |
| 5,175,969 A | * | 1/1993 | Knauf et al. | 52/239 |
| 5,187,908 A | * | 2/1993 | Losensky | 52/239 |
| 5,209,035 A | | 5/1993 | Hodges et al. | |
| 5,274,970 A | * | 1/1994 | Roberts | 52/239 |
| 5,381,994 A | | 1/1995 | Welch | |
| 5,487,246 A | | 1/1996 | Hodges et al. | |
| 5,642,593 A | * | 7/1997 | Shieh | 52/220.7 |
| 5,901,512 A | * | 5/1999 | Bullwinkle | 52/220.7 |
| 6,098,358 A | | 8/2000 | Waalkes et al. | |
| 6,202,381 B1 | * | 3/2001 | Dame et al. | 52/745.1 |
| 6,218,612 B1 | * | 4/2001 | McKitrick et al. | 174/48 |
| 6,235,988 B1 | | 5/2001 | Karst et al. | |
| 6,253,509 B1 | | 7/2001 | Hellwig et al. | |
| 6,301,846 B1 | | 10/2001 | Waalkes et al. | |
| 6,330,773 B1 | | 12/2001 | MacDonald et al. | |
| 6,351,917 B1 | | 3/2002 | MacDonald et al. | |
| 6,408,579 B1 | | 6/2002 | Anderson et al. | |
| 6,481,168 B1 | | 11/2002 | Hodges et al. | |

FOREIGN PATENT DOCUMENTS

EP 302564 A2 * 2/1989 ..... E04B/1/92

* cited by examiner

*Primary Examiner*—Peter M. Cuomo
*Assistant Examiner*—Stephen D'Adamo
(74) *Attorney, Agent, or Firm*—Joseph H. Golant; Jones Day

(57) ABSTRACT

A base plate assembly and method of forming a base plate assembly for use with a wall panel structure that is pleasing in appearance, simple in construction, and easy to install. The base plate assembly is generally u-shaped with top and bottom flanges. Prongs are associated with the top flange that snap into slots on each side of the base of adjacent vertical members that hold wall panels. Slots are located in the bottom flange of the base plate assembly and fit over vertical tabs on each side of spaced supports that enable the height of the vertical members to be adjusted. Pivoting the base plate assembly upward about the vertical tabs allows the prongs to be inserted and locked in the corresponding slots in each side of the base of the adjacent spaced vertical members thereby forming a volume in which electrical wiring, including electrical outlets, may be located.

7 Claims, 1 Drawing Sheet

BASE ASSEMBLY FOR WALL PANEL CONSTRUCTION

BACKGROUND OF THE INVENTION

1. Field of the Invention

The present invention relates in general to a base assembly for portable wall panels and, in particular, to a base assembly that encloses an area for containing electrical circuits and that is simply constructed and easy to assemble.

2. Description of the Related Art

Frames for office partition systems are increasingly in use and require not only portability and ease of construction to reconfigure office space but also to include the necessary electrical wiring facilities for the connection of equipment such as computers, lighting, and the like.

There are many patents on such systems and representative patents include U.S. Pat. Nos. 4,593,505; 4,918,886; 5,062,246; 5,209,035; 5,381,994; 5,487,246; 6,098,358; 6,235,988; 6,253,509; 6,301,846; 6,330,773; 6,351,917; 6,408,579; and 6,481,168.

The wiring facilities disclosed by these patents generally show an open space at the bottom of the structure that can be closed by panels on each side to provide a space for the electrical wiring and outlets.

As these patents show, there are many different ways of providing the space for electrical wiring. They are complex and difficult to manufacture as well as to assemble. It would be desirable to have a simple procedure and apparatus for providing such space.

SUMMARY OF THE INVENTION

The present invention provides a simple method and apparatus that can be used to accommodate electrical wiring in such portable panels. In the invention, the outer face of a u-shaped base plate (or kick plate) can be viewed at all times. Simple tabs and slots are used to install the base plate on each side of, and below, the panels in a snap-in fashion to form a volume in which electrical wiring and outlets can be located.

At least one horizontal member is connected to adjacent vertical members near the base thereof to hold them in a spaced relationship.

Since the panels are movable, or portable, they need to have a foot, or slide feature, that will enable them to easily glide over floor surfaces. In the present invention, this feature is provided by a glide tower, or support. These supports are mounted at each end of a base rail where the outer ends of the base rail are connected to the supports to maintain them in spaced relationship. On each side of each glide tower or support there is a vertically extending tab on which the base plate is to be mounted by a corresponding slot in a bottom flange of the base plate. In the base of each spaced vertical member is a slot into which a projection or prong extending outwardly from a top flange of the u-shaped base plate can be inserted. Thus, to mount the base plate to the spaced vertical members, the slots in the bottom flange of the base plate are placed over corresponding tabs on each glide tower or support and then the u-shaped base plate is moved pivotally upward until the prongs or projections on the top flange of the base plate are snapped into the corresponding slots in adjacent vertical members. A base plate is mounted to tabs on each side of spaced glide towers or supports and to slots in the base of the vertical members to form an enclosed volume in which electrical wiring and outlets may be located.

At least one of the u-shaped base plates on either side of the spaced glide towers has window openings into which electrical outlets, for example, may be placed. If the window outlet is not to be used, a window cover is snapped in place over the window opening from the inside face of the u-shaped base plate or kick plate. It snaps into place between the top and bottom flanges that form the u-shape of the base plate with the top of the window cover fitting under a lip formed on the top flange and the bottom of the window cover having a detent that snaps into a recess formed in the bottom flange of the base plate. The window cover has an embossed area on its face that matches the window opening in the base plate so that when the window cover is placed over the window opening, the embossed area fills the window opening space to form a substantially smooth outer face on the base plate.

Thus, it is an object of the present invention to provide a base plate, or kick plate, for a wall panel system that is simple to install and easy to modify to create a customized wall panel system.

It is also an object of the present invention to place a support under the wall panel system that includes a locating tab on each side of the support for attaching the bottom flange of a base plate thereto with slots formed in the base of adjacent spaced vertical members for receiving corresponding prongs or projections on the upper flange of a base plate such that when the base plate slots are placed over the tabs on either side of the adjacent glide towers and the base plate is rotated upwardly, the prongs or projections extending from the upper flange of the u-shaped base plate are inserted, in a snap-in fashion, in the slots on either side of the base of the vertical members thereby providing an enclosed volume formed by the opposing u-shaped base plates, the horizontal member, and the base rail for containing electrical wiring and associated apparatus.

It is also an object of the present invention to provide covered window openings in at least one of the opposing u-shaped base plates such that, when needed, the cover on a window opening may be easily removed to accommodate an electrical outlet without the use of mechanical attachments such as screws.

It is a further object of the present invention to provide a unshaped base plate having top and bottom flanges with a lip formed in the top flange and an opposing recess formed in the bottom flange such that the top edge of a window cover plate can be inserted under the lip formed in the base plate top flange and an opposing detent in the window cover bottom edge can be snapped into the recess formed in the base plate bottom flange.

It is yet another object of the present invention to provide the window cover with an embossed area that matches the window opening in the base plate such that when the window cover is placed over the window opening, the window cover embossed area fills the window opening to form a substantially smooth outer face on the base plate.

Thus, the invention relates to a base assembly used in wall panel construction in which spaced vertical members, each of which has opposing sides and a base, hold the wall panel and in which a horizontal member is coupled between the bases of adjacent vertical members to hold said vertical members in said spaced relationship, the base assembly comprising a support or glide member under each end of the horizontal member, each of the supports having opposing sides and a front; substantially vertically extending tabs formed on each side of each support; slots created in the opposing sides of the base of each vertical member; base plates with slots in a bottom flange corresponding to the vertical tabs on spaced supports and prongs in a top flange corresponding to the slots on the base of the spaced vertical members; and the slots in the base plate bottom flange receiving the vertical tabs on each side of spaced ones of the supports and the prongs on the base plate top flange being snapped into corresponding ones of the slots on each side of the spaced vertical members thereby creating an enclosed volume in which electrical wiring, including electrical outlets, can be located.

BRIEF DESCRIPTION OF THE DRAWINGS

These and other objects of the present invention will be more fully disclosed when taken in conjunction with the following detailed description of the drawing in which like numerals represent like elements and in which the FIGURE is an exploded perspective view of the bottom of the panel assembly illustrating how the base plates are to be affixed thereto to form an enclosed volume in which electrical wiring and electrical outlets can be placed.

DETAILED DESCRIPTION OF THE DRAWING

Figure 1:
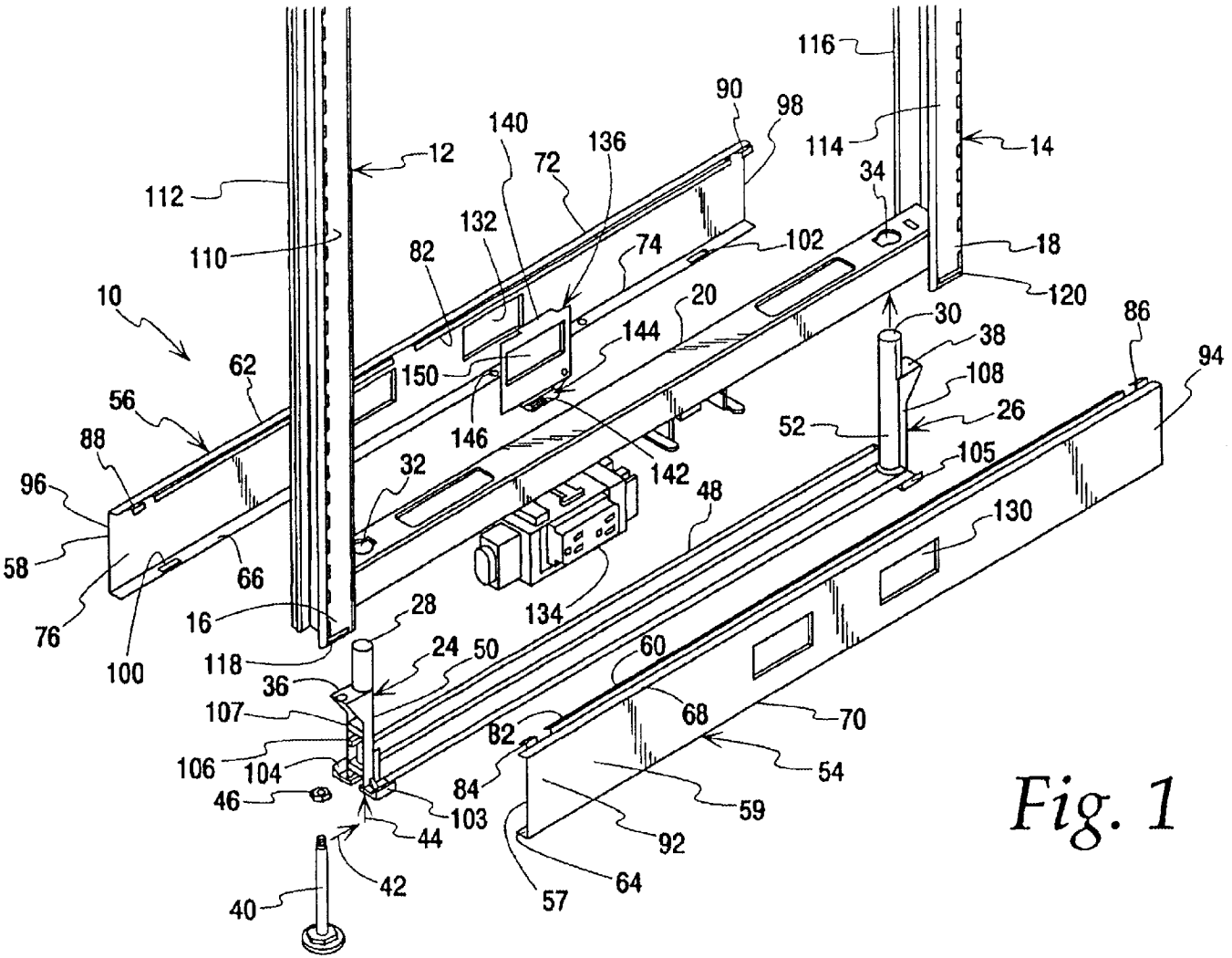

As can be seen in the FIG. 1, an exploded perspective view of components of the lower portion of a wall panel assembly illustrates the components thereof and their relationship to each other.

The construction of a wall panel base assembly 10 involves the use of spaced vertical members 12 and 14. Panel boards (not shown) are attached to each pair of the vertical members 12 and 14 in a well-known fashion. Each of the vertical members 12 and 14 has a base or base portion 16, 18. Connected between the base portions 16, 18 of adjacent vertical members 12 and 14 in any desired manner is a horizontal member 20. One of the functions of horizontal member 20 is to hold the base portions 16, 18 of the vertical members 12 and 14 in their spaced relationship. Each of first and second supports 24 and 26 has an upper post or head portion 28, 30 that is inserted in corresponding openings 32, 34 in each end or end portion of the horizontal member 20. Projections or ledges 36, 38 on each support 24 and 26 are used to fasten the supports to the horizontal member 20 with screws in a well-known fashion.

A leveling device or stud comprises a bolt 40 that is inserted in an opening in the base of each support 24 and 26 by moving the bolt 40 in the horizontal direction as shown by arrow 42 and upwardly as shown by arrow 44. The bolt 40 is held in place with threaded nut 46 and may be screwed into and out of the support 24, 26 to level the panel assembly as needed.

A base rail 48 is connected between opposing front faces or front portions 50, 52 of the supports 24 and 26. It can be seen that the base rail 48 and the horizontal member 20 are in spaced vertical relationship with each other and form a volume with open sides in which electrical wiring, including electrical outlets, may be enclosed by opposing base plates 54, 56 as explained in detail hereafter. As can be seen in FIG. 1 each base plate 54, 56 is substantially u-shaped and includes a side wall 57, 58 with an outside face, such as the outside face 59 of the base plate 54. A top flange 60, 62 and a bottom flange 64, 66 extend outwardly from at least a portion of top and bottom edges 68, 70 and 72, 74 of each inside face of the base plates, such as the inside face 76 of the base plate 56, in a substantially perpendicular fashion to form the u-shape. A lip 80, 82 is formed on the top flanges 60, 62. In addition, a prong or projection 84, 86, 88, 90 is formed near each end or end portion 92, 94, 96, 98 of the base plates 54, 56. Further, a slot opening is formed at corresponding spaced locations near each end portion of the bottom flanges 64, 66 of each of the base plates 54, 56, such as the slot openings 100, 102 in the bottom flange 66 of the base plate 56.

A vertically extending tab, such as the tabs 103, 104, 105, is formed on each side or side portion 106, 107, 108 of each support 24 and 26. These tabs, such as the tab 104 correspond to the slots, such as the slot 100 and are intended to be inserted in a corresponding one of the slots on the bottom flanges.

A slot is formed in the base portions 16, 18 on each of the sides 110, 112, 114, 116 of the vertical members 12 and 14, such as the slots 118, 120. These slots in the vertical members are intended to receive a corresponding one of the prongs or projections extending outwardly from the top edges at each of the ends of the base plates, such as the prongs 84, 86. Thus, when the slots of the bottom flanges of the base plates are placed over corresponding ones of the tabs on the supports and are pivoted upwardly, the prongs extending outwardly from the top edges snap-fit into corresponding ones of the slots in the bases of the vertical member 12, 14 and lock the base plates on each side of the volume formed by and between the horizontal member and the base rail thereby enclosing the volume and forming a space for electrical wiring therein.

At least one window opening 130, 132 is formed in the side walls 57, 58 of the base plates 54, 56 for receiving an electrical receptacle, such as an electrical outlet 134. A window cover 136 is removably located on the inside of the base plate 56 for covering the window opening 132 if it is not needed.

As can be seen, the window cover 136 is larger than the window opening 132. The window cover is mounted on the inside face 76 of the u-shaped base plate 56 and has a top portion or upper edge 140 as shown, that snap-fits under the lip 82 on the top flange 62. It also has a detent 142 extending downwardly from the bottom portion 144 as shown. The bottom flange 66 of the base plate 56 has a recess 146 for receiving the detent 142. Thus, when the detent is placed into the recess and the window cover is pivoted upwardly about the detent, its top portion or upper edge 140 snaps under the lip 82 on the top flange 62 of the base plate 56 and is thus held in place by the latent spring tension exerted by the top and the bottom flanges 62, 66 of the base plate 56.

The window cover 136 has an embossed area 150 that mates with, and fills in, the window opening 132 in the side wall 58 of the base plate 56 so that when the window openings are not used for electrical receptacles, the window cover, mounted in place on the inside face 76 of the u-shaped base plate 56, as indicated above, gives the outside face of the u-shaped base plate a solid appearance that is esthetically pleasing.

Thus, there has been disclosed a novel base assembly and method of forming a base assembly that is pleasing in appearance, simple in construction, and easy to install. Simply place the slots in the bottom flange of the base plate over corresponding ones of the tabs on the spaced supports, pivot the base plate upwardly such that prongs extending outwardly from the top flange of the base plate are inserted in, and locked to, corresponding spaced slots in the base of each vertical member.

While the invention has been disclosed in conjunction with a preferred embodiment, it is to be understood that it is not intended to limit the scope of the invention to the particular apparatus and method set forth, but, on the contrary, it is intended to cover such alternatives, modifications, and equivalents as may be included within the spirit and scope of the appended claims.

What is claimed is:

1. A base assembly for a wall panel assembly, the base assembly comprising:

two vertical members, each of said vertical members having a base;

a horizontal member connected to the bases of said vertical members, said horizontal member having an opening at each of opposing end portions;

first and second vertically directed supports, each support having opposing sides, a front and a ledge, each of said supports being mounted under said horizontal member and through a corresponding opening of said horizontal member wherein said ledges support said horizontal member and said vertical members, each of said first and said second vertically directed supports includes extending tabs on each of said sides;

first and second leveling studs mounted in said first and said second supports;

a horizontal disposed base rail connected to said front of said first and said second supports and being vertically spaced from said horizontal member for defining a volume for electrical equipment; and first and second U-shaped base plates, each base plate having a side wall with top and bottom edges and first and second ends, and top and bottom flanges extending from said top and bottom edges of said side wall, each of said bottom flanges having openings wherein said openings in said bottom flanges of said base plates receive tabs of said supports and said top flanges of said base plates are engaged after said base plates pivot upwardly whereby said volume is enclosed.

2. The base assembly of claim 1, further comprising:

at least one window opening in the side wall of at least one of said base plates for receiving an electrical receptacle; and a window cover on the inner side of said u-shaped base plate for covering said window opening when said window opening is not to be used.

3. The base assembly of claim 2 wherein said window cover comprises:

a plate larger than the window opening area in said base plate and having a top portion and a bottom portion;

a lip on the upper flange of said base plate and a recess in the bottom flange of said base plate substantially opposing said lip;

an embossed area on said window cover plate that mates with, and fills in, the window opening in the face of the base plate;

the top portion of said window cover plate being received by said upper flange lip; and a detent on the bottom portion of said window cover plate being received by said bottom flange recess thereby enabling said window cover to be snapped in place over said window opening with said embossed area mating with said window opening.

4. The base assembly of claim 1, further comprising:

said leveling studs associated with said supports for enabling each vertical member to be individually adjusted in height in the vertical plane for leveling of the wall panels.

5. The base assembly of claim 4 wherein each leveling stud is a threaded bolt that is movable relative to each support.

6. A base assembly for a wall panel structure, the base assembly comprising:

two vertical members adapted to support a wall panel, each of said vertical members having a lower portion;

a horizontal member connected to said lower portions of said vertical members, said horizontal member having an opening at each of opposing end portions;

first and second vertically arranged supports, each support having a head portion, opposing side portions, a front portion and a ledge portion, each of said supports being mounted under said horizontal member and said head portion extending through a corresponding opening in said horizontal member wherein said ledge portions are under said horizontal member and each of said first and said second vertically directed supports includes tabs extending from each of said opposing side portions;

first and second leveling studs mounted in said first and said second supports;

a horizontally disposed base rail connected to said front portions of said first and said second supports under said ledge portions and being vertically spaced from said horizontal member for defining a volume; and first and second base plates, each of said base plates having a side wall with top and bottom edges and first and second end portions, and top and bottom flanges extending from said top and bottom edges of said base wall, each of said bottom flanges having spaced apart openings for receiving said tabs of said first and said second supports wherein after said openings in said bottom flanges of said base plates receive said tabs of said supports and said top flanges of said base plates are engaged after said base plates pivot upwardly, said volume between said horizontal member and said base rail is enclosed.

7. The apparatus of claim 6 wherein:

said top flanges engage in a snap fit.

* * * * *